United States Patent [19]

O'Connor

[11] 3,990,428

[45] Nov. 9, 1976

[54] POT-TYPE BURNER USING SONIC RESONANCE FOR INCREASED EFFICIENCY

[75] Inventor: Jon Francis O'Connor, Evanston, Ill.

[73] Assignee: Vapor Corporation, Chicago, Ill.

[22] Filed: Nov. 25, 1974

[21] Appl. No.: 526,960

[52] U.S. Cl. ..... 126/94; 431/287; 431/340; 431/335

[51] Int. Cl.[2] ..... F24C 5/00

[58] Field of Search ..... 431/195, 196, 287, 333, 431/335, 336, 340, 342; 126/93, 94

[56] References Cited

UNITED STATES PATENTS

| | | | |
|---|---|---|---|
| 2,252,182 | 8/1941 | Kahn | 431/340 |
| 2,699,819 | 1/1955 | Grubb | 126/93 |
| 3,017,925 | 1/1962 | Breese et al. | 431/340 |
| 3,176,752 | 4/1965 | Huston | 431/287 |
| R22,332 | 6/1943 | Sabins | 126/94 |

FOREIGN PATENTS OR APPLICATIONS

| | | | |
|---|---|---|---|
| 249,625 | 4/1963 | Australia | 126/93 |
| 98,296 | 6/1961 | Netherlands | 126/94 |
| 97,671 | 1/1961 | Norway | 126/94 |

OTHER PUBLICATIONS

Oil Burner Pulsations, by C. F. Speich and A. A. Putnam (1963).

*Primary Examiner*—Carroll B. Dority, Jr.
*Attorney, Agent, or Firm*—Francis J. Lidd

[57] ABSTRACT

A pot-type burner is equipped with baffle plates for establishing recirculation zones within the burner for efficiently mixing air and gas in a conventional manner. The burner construction is improved by removing the combustion ring, and in its stead adding an annular dome. This initiates sonic pulsations, sustained within a heat exchanger housing which has critical dimensions relative to the burner parts. The pulsations produce improved combustion.

5 Claims, 2 Drawing Figures

POT-TYPE BURNER USING SONIC RESONANCE FOR INCREASED EFFICIENCY

FIELD OF THE INVENTION

The present invention relates to heaters or burners, and more particularly to a high turbulence vaporizing burner.

BRIEF DESCRIPTION OF THE PRIOR ART

The basic heater of the present invention incorporates a well-known evaporative hydroxylating pot-type burner. Such a burner is disclosed in U.S. Pat. No. 2,509,819. In the trade, this type of burner is also known as a Breese burner. The Breese burner has been employed in a number of applications due to the fact that it renders satisfactory performance by converting liquid fuel to a clean burning gas with near complete combustion. An extremely hot, stabilized flame results.

In operation of this prior art burner, hydrocarbons formed through hydroxylation, mix with oxygen to form alcohols and aldehydes. Precise execution of the initial hydroxylation step is extremely important toward achievement of complete combustion. Oxygen and hydrocarbon molecule mixture produces an alcohol More oxygen mixed with the alcohol forms an aldehyde. At this point, impinging jet holes, located in the burner assembly outer wall and turbulence components, come into play. Air admitted through these holes provide turbulent air jets inside the burner causing the aldehyde to burn completely into water and carbon dioxide. The result is a relatively clean, quiet, and efficient burner providing an extemely hot flame.

Recently, the pot burner has been modified to include turbulence inducing baffle plates or combustion rings that create recirculation zones within the burner for more efficiently mixing air and fuel gas. One such improvement is manufactured by Cats-Eye Lamp Division of Holophane, Incorporated and carries the trademark GYRO JET. This improved prior art structure was developed because some of today's modern catalytic blends of fuel are extremely stable, and often do not readily unite with oxygen. Because of this, in older type burners, these fuels have a tendency to crack and produce large amounts of free carbon. The GYRO JET construction forces more air to be added near the top of the burner with impinging inlet holes thus resulting in extremely high temperature jets of flame. The result is a minimizing of free carbon deposits in the flue or burner.

Although the prior art constructions have operated generally satisfactorily, greater efficiency is required due to the higher cost of fuel and pollution requirements. Further, the prior art burners present problems in maintaining combustion and efficiency in environments where adverse weather and vibration conditions exist.

BRIEF DESCRIPTION OF THE PRESENT INVENTION

The present invention constitutes an improvement over prior art Breese pot burners. A burner dome replaces the conventional combustion ring used on pot-type burners. The dome in cooperation with the internal baffles create additional recirculating zones and accompanying vortices in the combusting gases causing pulsations to occur within a heat exchanger housing, above the burner. Critical dimensions exist for creating a resonator to sustain the sonic oscillations that increase the efficiency of the burner.

It is worthy to note that studies by experts have indicated that the existence of pulsations were "disproved" to be of benefit. For example, see the paper prepared for presentation at the ASHRAE semiannual meeting, Feb. 13–16, 1961, entitled "Oil Burner Pulsations and Their Amplitudes," by C. F. Speich and A. A. Putnam. In essence, experts have long considered pulsations in oilfired equipment to have been a source of annoyance to the heating industry.

The present invention is made possible by discovering that pulsations of sufficient magnitude and energy occur in a pot or evaporative burner and have a dominant frequency which may be utilized to increase efficiency, if the pulsations are properly harnessed. This is done by adjusting the geometry of the burner-heat exchanger housing structures to resonate at the dominant frequency. By virtue of the present invention, increased heater output over the prior art has been realized. Typically, 30 percent greater output from the same size unit has been achieved.

Further, a more reliable and efficient unit permits the basic burner structure to be employed successfully in an adverse environment. For example, consider the use of this type of heater in a railroad caboose. A caboose is often a home for operating train crews, and heaters have a great utility as they provide warmth and a place to prepare food. The freight train environment is difficult with maintenance at a minimum. Therefore, it is necessary to provide an economical, safe, and efficient heater which is reliable and easy to operate. A particularly difficult problem with a simple unit of this type is maintaining combustion and efficiency during vehicular transport over rough roadbeds, and under adverse weather conditions. The improvement, which constitutes the present invention, results in superior performance in an adverse environment, when compared with the prior art.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
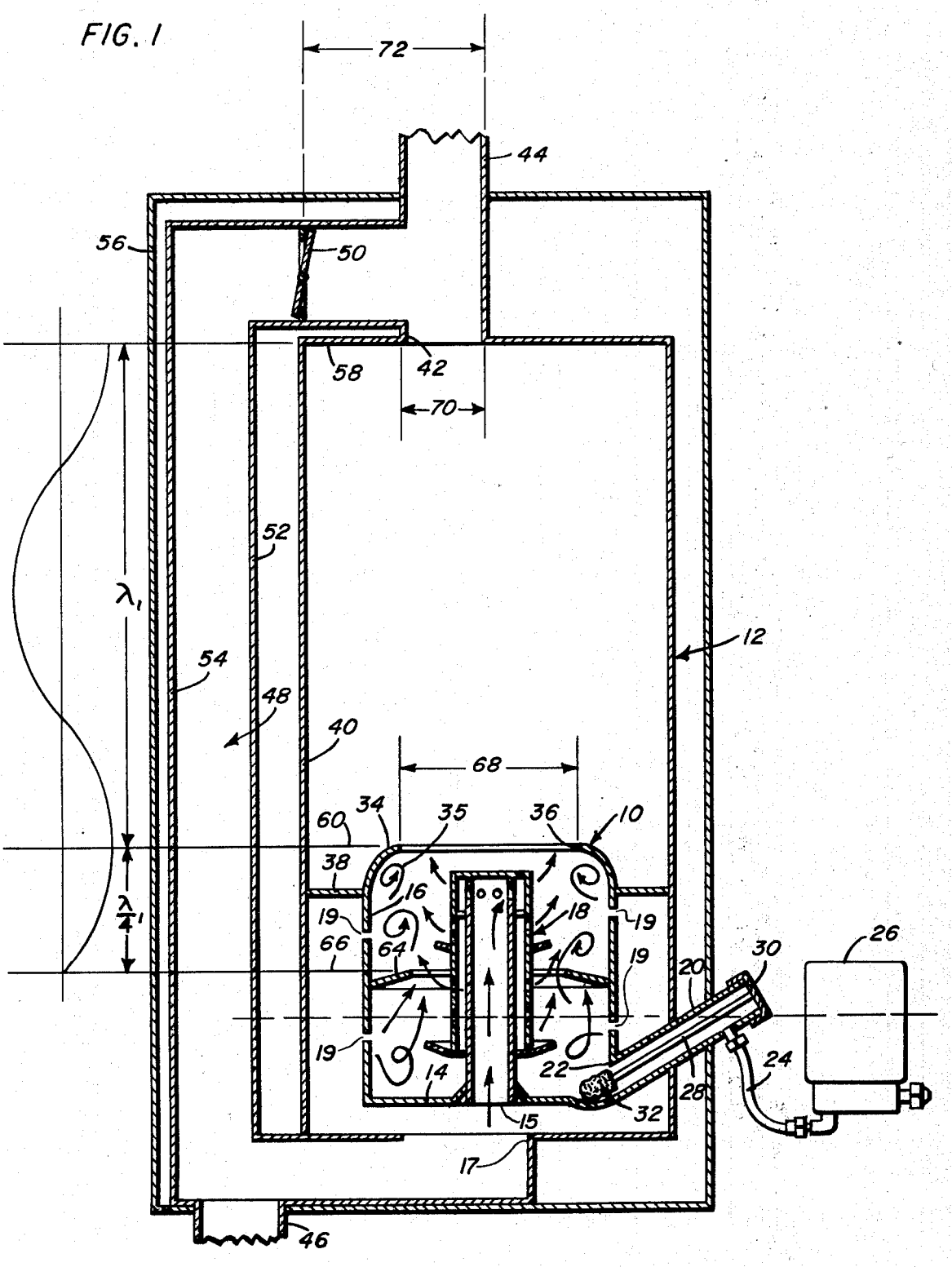
FIG. 1 is a cross sectional view of a typical installation of the present invention, using a pot-type burner, in conjunction with a heat exchanger. Critical dimensions are indicated for a resonator for sustaining vaporized fuel pulsations or oscillations within the assembly.

Referring to FIG. 1, reference numeral 10 generally indicates the burner portion of the invention, which as is previously explained is of conventional design modified in accordance with the invention and is disposed within a heat exchanger housing 12. The burner includes a bottom wall 14 defining a primary air inlet 15, which articulates to a cylindrical wall 16 containing air inlet holes 19. Within the burner is located a turbulence device, such as the previously mentioned GYRO JET. This device is manufactured by the Cats-Eye Lamp Division of Johns-Manville Company. A fuel injector 20 communicates between the outside of the housing 12 and the lower inside portion of the burner 10 below the burner air inlet holes. Liquid fuel is fed from a reservoir 26 through the fuel injector 20. A connection is made between these components by a connecting pipe 24. An ignitor 28 is slideably positioned within the fuel injector 20. The outward end of the ignitor is attached to a cap 30. In order to ignite the burner, the cap 30 is pulled off, thus removing the ignitor 28. A wick 32 is saturated with fuel and ignited by other means. Then, upon reinsertion into the fuel injector 20, the combustion process is initiated. A flame will develop inside the burner 10 as well as on the upper portion of the burner 10, stabilizing on the upper portion. Thus, the ignitor will become extinguished in a short period of time and temperatures will remain relatively low in the region of the fuel injector 20 due to fuel evaporation and increased airflow.

Instead of the conventional combustion ring located at the top or upper end of the burner 10, the present invention utilizes an annular dome or ring 34 that extends upwardly from the cylindrical wall 16 of the burner. A large opening 36 is formed coaxially with the turbulence assembly 18. An annular seal and support plate 38 is provided to support the burner 10 to the inside of the heat exchanger housing 40. A combustion air inlet 17 is located in the lower end of the heat exchanger housing to admit combustion primary air to the primary air inlet 15. An extremely high temperature flame front develops within the burner, having a very short vertical extension and in close proximity to the baffle ring 64, establishing a flat fixed flame surface closely adjacent to the surface of baffle 64.

Heat rises above the burner 10 and exhaust takes place through the housing outlet or vent 42 and the stack 44. A low turbulence boundary layer is developed along the interior surface of the heat exchanger housing 40. However, due to the present invention, combustion pulsations produce increased turbulence within the heat exchanger housing which improve the heat transfer efficiency.

The flue of the assembly illustrated in the figure is merely illustrative and includes an air inlet 46 which communicates with the stack 44 via the auxilliary passageway 48, which exists between the outer heat exchanger housing wall 52, and a further outer assembly wall 54. A barometric control valve 50 is positioned between the passageway 48 and the stack 44. This permits a regulation of airflow through the passageway 48. The control valve 50 is usually closed but will open when pressure falls beneath a preselected threshold. The purpose of the valve is to bypass the main cavity, inside the housing 12, and prevent excessive airflow entering the primary air inlet 15 which would draw combustion products toward the stack 44 before combustion is complete. An outer assembly wall 56 completes the basic structure of the invention.

Critical dimensions exist between the various parts of the structure illustrated to provide a resonator for the pulsations produced in the combustor. The distance between outlet or vent 42 in the upper wall 58 of the heat exchanger housing and the upper end of the dome 60 is four times the distance between the upper end of the dome 60 and the upper end of the baffle ring 64, as indicated by 66. It should be noted that the ring 64 and turbulence assembly 18 prevent recirculation of combustion products below the ring and further serves to define the bottom end of the resonator.

The openings combustion gas passage 36 vent 42 are circular. Further, the diameter 68 of passage 36 is greater than the diameter 70 of vent 42. Further, the dimension 72, between the control valve 50 and the right wall of the stack 44, is greater than the diameter 70 of opening 42. In a particular installation, the dimension 72 is fixed to optimize the amplitude of the pulsations occurring within the enclosure 12.

In operation of the present invention, heating is accompanied by gas pulsations within the heat exchanger housing 12. Typically, frequencies of 50 Hz per second occur. As schematically shown by the standing wave λ, shown in FIG. 1, acoustical oscillations are produced by establishing a virtual resonator consisting of the combustion chamber geometry, and with critical distance ratios, as previously outlined. The pulsations have in essence been harnessed, and provide beneficial results by virtue of breaking the boundary layer, which would ordinarily build up along the inner surface of the heat exchanger wall 40. Further, the pulsations reinforce molecular vibration of the flame area which promotes combustion. Still further, the pulsations increase the turbulence within the burner that more thoroughly results in the mixing of air and vaporized fuel.

The burner ignition offers advantages not heretofore recognized in pot burner construction. For example, with the fuel injector 20 communicating with the burner, the ignition parts are located below the primary air inlet holes (not shown) which exist in the wall 16 of the burner. This results in reduced interference with the combustion process. Further, removal of the ignitor 28 provides a convenient inspection port and a view of the fuel vaporization area. Further, because the ignitor 28 is located in proximity with the fuel supply and air inlets, a high temperature/energy ignitor is not required.

In operation of the ignitor, fuel entering the burner passes over the ignitor wick 32. The ignitor 28 may be withdrawn from the fuel injector 20 and ignited by a match or other heat source. Then, it is reinserted so that the burning end is located as shown in the figure. As ignition of the main burner begins, fuel evaporation and increased primary airflow reduce the temperature of the ignitor assembly thus providing greatly increased life. Since combustion does not take place at the ignitor location, except during ignition, it is possible to remove the ignitor with the heater in operation to inspect fuel flow and/or the condition of the burner internals.

With respect to the dome 34, it is theorized that vortices are formed in the recirculation zone indicated by 35, due to the peculiar turbulence and additional vortex formation created under the dome 34. Because of the resonator construction of the invention, the oscillations are maintained and a beneficial effect is realized. This is contrary to the previous findings of experts in this area of technology, who have found pulsations to be a problem.

Figure 2:
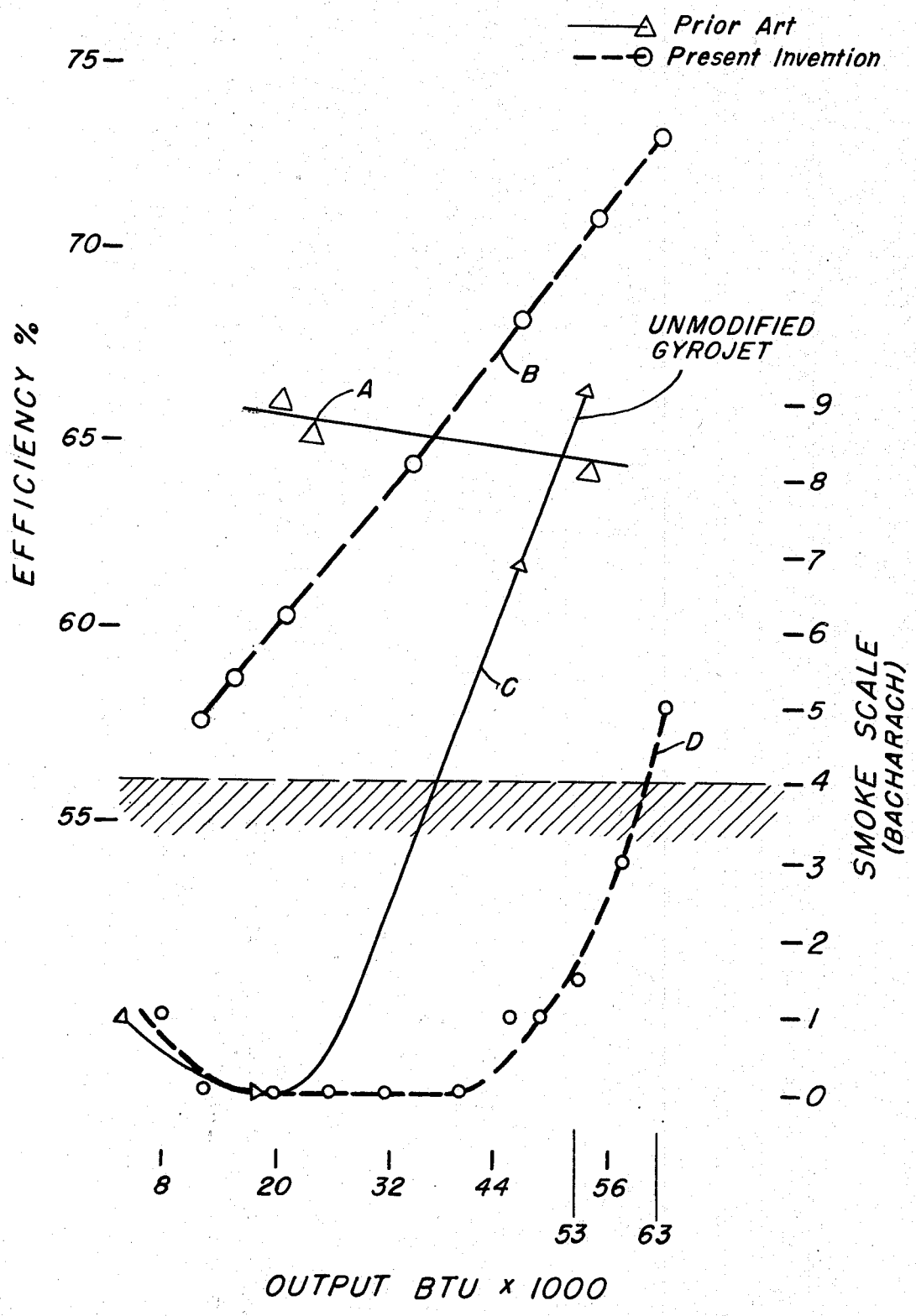
FIG. 2 is a dual plot comparing efficiency and smoke as a function of output BTU capacity, for a prior art installation as compared with the present invention.

FIG. 2 illustrates a dual plot of a typical prior art burner, as compared with a comparable burner utilizing the concept of the present invention.

Plots A and B indicate the superior efficiency of the present invention (plot B) when compared with a typical prior art burner (plot A). The increased efficiency of the present invention for comparable output BTU becomes apparent in the output BTU range normally encountered.

Plots C and D indicate the superior performance of the present invention (plot D), in lower smoke production, when compared with a typical prior art burner (plot C). Smoke production is measured as a function of the Bacharach Smoke Scale and a function of output BTU. The plot shown in FIG. 2 are graphical representations of empirical data, performed during an actual experiment.

It should be understood that the invention is not limited to the exact details of construction shown and described herein for obvious modifications will occur to persons skilled in the art.

What is claimed is:

1. A heater comprising; a vaporizing pot burner having a bottom wall and upper end for combusting liquid fuel;

a contoured annular dome at said upper end defining a combustion gas passage;

a baffle ring spaced intermediate said bottom wall and said annular dome;

a fuel injector adjacent to said bottom wall;

a primary air inlet in said bottom wall;

a turbulence assembly coaxially arranged with said gas passage and including means to direct said primary air radially;

a heat exchanger housing having sidewalls, first and second ends, and having said burner contained in said heat exchanger adjacent to said second end, such that said dome is in spaced relationship to said first end;

wherein spacing of said annular dome and heat exchanger first end is essentially four times the spacing of said baffling and said annular dome.

a primary air opening in said heat exchanger second end;

a vent located in said heat exchanger first end providing an outlet for said combustion gases;

a stack for venting said combustion gases to the atmosphere and, an auxiliary passageway lateral of said heat exchanger side wall with upper and lower ends, communicating with said primary air opening at said lower end and with said stack at its upper end, and a pressure sensitive valve contained in said passage way spaced from said upper end, wherein said burner, dome, auxiliary gas passage, annular baffle, primary air opening, primary air inlet, and heat exchanger vent establish an accoustical standing wave, resonating pulsations to increase the efficiency of said burner and heat exchanger, 2. The heater of claim 1, together with burner ignition means comprising;

a fuel injector pipe having inner and outer ends, inner end entering the burner lower end at a point adjacent to said lower end;

an intermediate point of the pipe admitting fuel therethrough to the burner;

means supplying fuel to said intermediate point, and an ignitor having inner and outer ends, slideably positioned in the pipe, said ignitor having a wick at the inner end, and a retaining cover attached to the outer end for retention of said ignitor in and closure of the outer end of said pipe, wherein said injector pipe provides means for inspecting burner operation after ignition.

3. In a liquid fueled space heater having a gravity fed free convection vaporizing burner with air inlet holes and a fuel injector at its lower end, and a combustion gas outlet at its upper end generating combustion gas having pressure pulsations at a known frequency, means enclosing said burner in a heat exchanger, means venting said heat exchanger communicating with compensated stack means for equalizing burner combustion air and stack outlet pressure, the improvement comprising;

a domed cover for the burner defining a combustion gas passage at its upper edge, turbulence means defining an annular baffle ring, and a turbulence assembly within the burner, an annular collar within the heat exchanger providing a seal between the burner combustion gas outlet and the heat exchanger enclosure, the spacing of said annular dome and venting means is essentially four times the spacing of said baffle ring and domed cover, wherein the burner, turbulence means, seal collar, heat exchanging enclosure, and stack means cooperate to resonate at the frequency of the combustion gas pulsations to improve combustion and increase heater output, and burner ignition means comprising;

a fuel injector pipe having inner and outer ends, said inner end entering the burner lower end at a point below the burner air inlet holes;

an intermediate point of the injector pipe admitting fuel therethrough to the burner; and an ignitor having inner and outer ends slideably positioned in the injector pipe, said ignitor having a wick at the inner end, and a retaining cover attached to the outer end for retaining and sealing the outer end of said injector pipe, wherein the fuel injector pipe provides a means for inspecting burner operation after ignition.

4. In a liquid fueled space heater;

a. pot burner means generating combustion gases having pressure pulsations comprising;

a burner housing having upper and lower ends, a domed cover for said upper end defining a combustion gas passage, a fuel inlet and a primary air inlet adjacent to said lower end, an internal annular baffle ring attached to said housing at its outer periphery, a turbulence assembly in said housing disposed in coaxial relationship to said combustion gas passage and baffle ring including means to direct said primary air radially into said housing, and cooperating with said baffle ring to define a flame front closely adjacent to said ring; and b. a heat exchanger enclosing said burner comprising;

a walled enclosure having upper and lower ends, and internal seal collar annularly disposed between said heat exchanger wall and said burner housing at a point below said domed cover, and adjacent to said enclosure lower end, maintaining said burner in spaced relationship to said heat exchanger upper and lower end, said heat exchanger upper end defining a vent, said heat exchanger lower end defining a combustion air inlet;

c. wherein said spaced relationship locates said burner in said heat exchanger so that the distance from the burner housing upper end to the heat exchanger upper end is approximately 4 times the distance between said burner housing upper end and said baffle ring.

d. stack attached to said heat exchanger means at said vent, an auxiliary passage communicating with said burner air inlet and further communicating with said stack means, a control valve in said auxilliary passage located in spaced relationship to said heat exchanger vent and stack means;

wherein said heat exchanger, vent, primary air inlet and stack means resonate with said pressure pulsation to establish an accoustical standing wave in said exchanger to improve heater performance.

5. The heater described in claim 4 wherein said control valve spacing exceeds the diameter of said vent.

* * * * *